US007850551B2

(12) United States Patent
Barber

(10) Patent No.: US 7,850,551 B2
(45) Date of Patent: Dec. 14, 2010

(54) MOBILE PRACTICE TARGETS

(75) Inventor: Gregory Warren Barber, Palo Alto, CA (US)

(73) Assignee: Athletic Instructional Methods, LLC, Palo Alto, CA (US)

( * ) Notice: Subject to any disclaimer, the term of this patent is extended or adjusted under 35 U.S.C. 154(b) by 0 days.

(21) Appl. No.: 12/501,391

(22) Filed: Jul. 10, 2009

(65) Prior Publication Data

US 2009/0280931 A1 Nov. 12, 2009

Related U.S. Application Data

(63) Continuation-in-part of application No. 11/962,088, filed on Dec. 20, 2007, now abandoned, and a continuation-in-part of application No. 11/078,088, filed on Mar. 11, 2005.

(60) Provisional application No. 60/552,597, filed on Mar. 12, 2004.

(51) Int. Cl.
*A63B 69/00* (2006.01)
*A63B 63/00* (2006.01)

(52) U.S. Cl. ..... 473/439; 273/400

(58) Field of Classification Search ..... 273/398–402; 473/438, 439, 456, 462, 476, 478, 197
See application file for complete search history.

(56) References Cited

U.S. PATENT DOCUMENTS

| | | | |
|---|---|---|---|
| 920,907 | A | 5/1909 | Bolton |
| 1,511,430 | A | 10/1924 | Schonberg |
| 1,745,201 | A | 1/1930 | Alston |
| 2,247,852 | A | 7/1941 | Saunders |
| 3,810,618 | A | 5/1974 | Nedwick |
| 4,344,621 | A | 8/1982 | Baker |
| 4,533,138 | A | 8/1985 | Rodriguez et al. |
| 4,718,668 | A | 1/1988 | Schipske |
| 4,723,780 | A | 2/1988 | Vinzetta |
| 4,836,542 | A | 6/1989 | Crawley |
| 5,037,095 | A | 8/1991 | Nedwick |
| 5,080,375 | A | 1/1992 | Moosavi |
| 5,252,076 | A | 10/1993 | Kelleher |
| 5,330,199 | A | 7/1994 | Vand |
| 5,333,856 | A | 8/1994 | Gery |
| 5,351,948 | A | 10/1994 | Thomas |
| 5,421,586 | A | 6/1995 | Amram et al. |
| 5,443,259 | A | 8/1995 | Segan et al. |
| 5,516,115 | A | 5/1996 | McLain |
| 5,588,645 | A | 12/1996 | Schwan et al. |

(Continued)

*Primary Examiner*—Mark S Graham
(74) *Attorney, Agent, or Firm*—Moore Patents; David Dreyfuss; Cynthia Moore

(57) ABSTRACT

A mobile practice target is described, which includes a framework comprising a base support and at least one substantially vertical support extending above the base support and an angled support above the vertical support, together with a pocket comprising a resilient material having at least one front opening parallel to the vertical support capable of receiving a football propelled from the horizontal direction, and a top opening parallel to the angled support for receiving a propelled football from above. A baffle is secured to the top of the front opening which can absorb the momentum of the propelled football and/or deflect the propelled football downward into the pocket. A mobility means associated with the base support is provided to facilitate transport of the mobile practice target. The mobile practice target captures and contains propelled footballs and prevents them from bouncing out of the pocket when traversing the front opening.

18 Claims, 8 Drawing Sheets

U.S. PATENT DOCUMENTS

| | | | |
|---|---|---|---|
| 5,722,446 | A | 3/1998 | Zheng |
| 5,772,537 | A | 6/1998 | Anderson et al. |
| 5,807,193 | A | 9/1998 | Talarico et al. |
| 6,155,936 | A | 12/2000 | Dorr |
| 6,277,039 | B1 | 8/2001 | Kleinschrodt |
| 6,299,556 | B1 | 10/2001 | Redden |
| 6,485,373 | B1 | 11/2002 | Stephens |
| 6,579,196 | B1 | 6/2003 | Yoon |
| 6,585,611 | B2 | 7/2003 | Vogel |
| 6,595,878 | B1 | 7/2003 | Nelson |
| 6,659,893 | B1 | 12/2003 | Campbell et al. |
| 6,679,795 | B2 | 1/2004 | Ouimette et al. |
| 6,736,738 | B1 | 5/2004 | Taa |
| 6,779,797 | B1 | 8/2004 | Chou |
| 6,811,501 | B2 | 11/2004 | Kuzia et al. |
| 7,056,241 | B1 | 6/2006 | Ishino |
| 2003/0125121 | A1 | 7/2003 | Rhee |
| 2004/0036222 | A1 | 2/2004 | Chou |
| 2004/0038759 | A1 | 2/2004 | Kuzia et al. |
| 2005/0134001 | A1 | 6/2005 | Rowan |
| 2005/0192126 | A1 | 9/2005 | Remaklus |

MOBILE PRACTICE TARGETS

CROSS-REFERENCE TO RELATED APPLICATIONS

This application is a Continuation-in-Part Application claiming priority from U.S. patent application Ser. No. 11/962,088, filed Dec. 20, 2007, which is a Continuation-in-Part of U.S. patent application Ser. No. 11/078,008, filed Mar. 11, 2005, and further claims priority from U.S. Provisional Patent Application No. 60/552,597, filed Mar. 12, 2004, all of which are incorporated herein by reference.

FIELD OF THE INVENTION

This invention relates to training equipment useful in the practice of sports, the development of throwing skills and the like.

BACKGROUND OF THE INVENTION

Many devices are known for the purpose of teaching basic throwing, hitting, kicking skills and the like for beginners or for more advanced players, typically under static conditions. Such devices include golf ball targets, devices for pitching practice, tennis training, football kicking practice and the like. For example, U.S. Pat. No. 6,679,795 to Ouimette discloses a portable target for baseball or softball pitchers. U.S. Pat. No. 5,516,115 to McLain, U.S. Pat. No. 5,037,095 to Nedwick and U.S. Pat. No. 5,333,856, to Gery describe devices having pockets provided in netting. U.S. Pat. No. 4,718,668, Schipske and U.S. Pat. No. 4,836,542 to Crawley describe the use of netting. U.S. Pat. No. 4,718,668 Schipske and U.S. Pat. No. 4,836,542 to Crawley describe the use of portable frames. U.S. Pat. No. 5,807,193 to Talarico and U.S. Pat. No. 5,516,115 to McLain describe adjustable sections of a framework. U.S. Pat. No. 6,277,039 to Kleinschrodt describes capturing an object such as a tennis ball. U.S. Pat. No. 5,516,115 to McLain describes an adjustable member that allows the angle of the vertical member to be adjusted.

Further, prior art devices are not designed to be specifically useful for the development of ball placement skills under simulated game conditions. For example, the apparatus described in U.S. Pat. No. 5,252,076 to Kelleher is intended for the development of receiving skills in games such as of football or baseball, where the athlete is trained to handle or catch balls under unpredictable conditions simulating the presence of a defender or obstructions in the line of sight to the quarterback or the ball. However, the device described in Kelleher acts as an obstacle to a live receiver, and thus does not describe a simulated moving target.

While the structural arrangements of the above described devices, at first appearance, have similarities with the present invention, they differ in material respects. These differences, which will be described in more detail hereinafter, are essential for the effective use of the invention and which admit of the advantages that are not available with the prior devices.

Accordingly, there is a need in the art for a practice target that is mobile, useful in the teaching of multiple skills across multiple sports under simulated playing conditions, useful indoors or out, and economical. In none of the devices mentioned above is there described a target capable of receiving driven, tossed, kicked or lofted propelled objects having the mobility and versatility needed for the intensive training of athletes. Similarly, none of these devices allows for the effective training of ball placement skills for driven versus lofted throws or for the development and accuracy of place kicking, punting, centering, and quarterbacking skills in the game of football.

SUMMARY OF THE INVENTION

A mobile practice target is described, which includes a framework comprising a base support and at least one substantially vertical support extending above the base support and an angled support above the vertical support, together with a pocket comprising a resilient material having at least one front opening parallel to the vertical support capable of receiving a football propelled from the horizontal direction, and a top opening parallel to the angled support for receiving a propelled football from above. A baffle is secured to the top of the front opening which can absorb the momentum of the propelled football and/or deflect the propelled football downward into the pocket. A mobility means associated with the base support is provided to facilitate transport of the mobile practice target. The mobile practice target captures and contains propelled footballs and prevents them from bouncing out of the pocket when traversing the front opening at speeds greater than about 30 mph. The mobile practice target can be used to practice a wide range of throws and kicks related to the game of football including both precision line passes and lofted passes.

DESCRIPTION OF THE PREFERRED EMBODIMENTS

Figure 1:
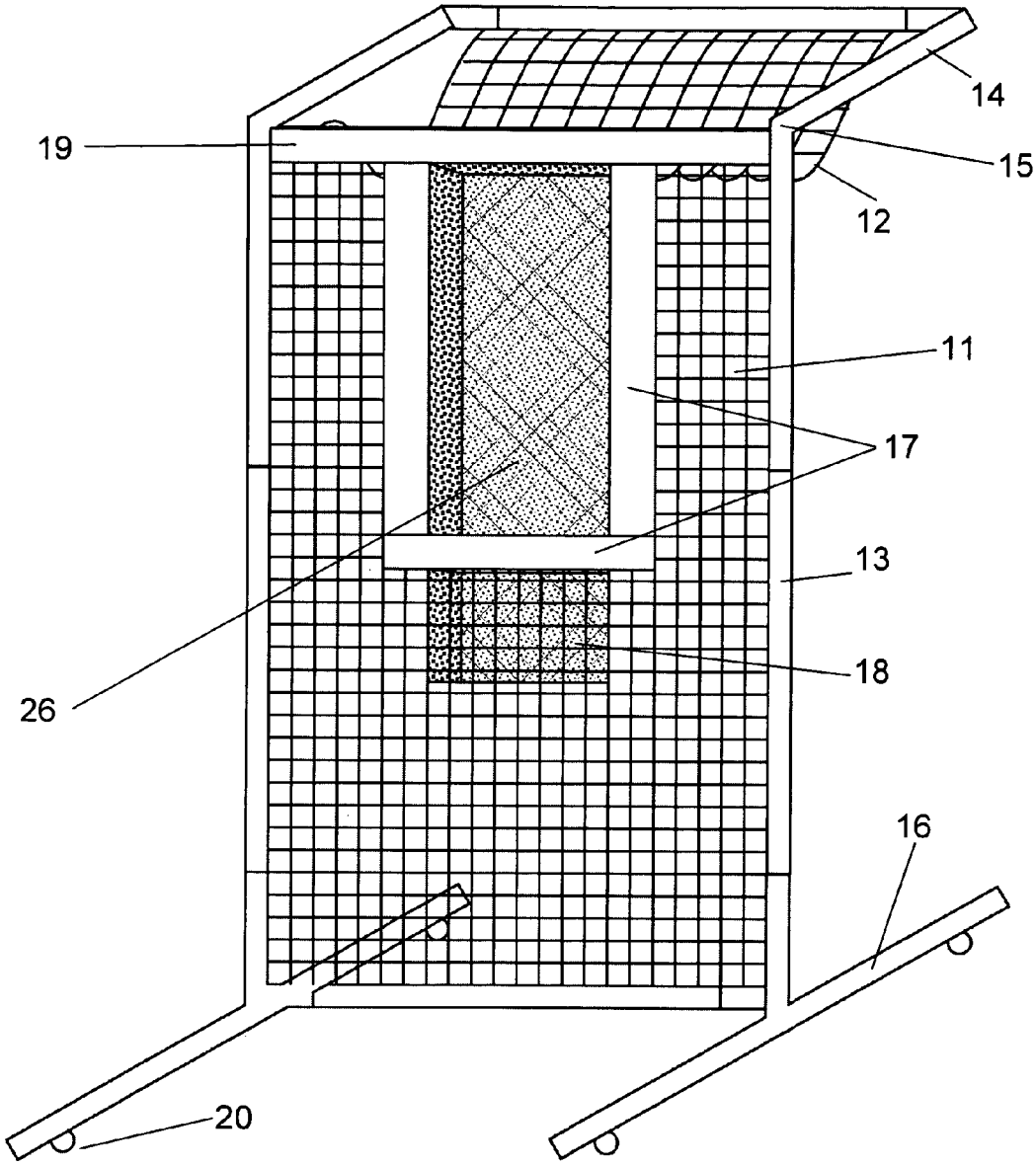
FIG. 1 illustrates one embodiment of the mobile practice target.

Before the present invention is described in detail, it is to be understood that unless otherwise indicated this invention is not limited to specific construction materials, netting, or the like, as such may vary. It is also to be understood that the terminology used herein is for the purpose of describing particular embodiments only and is not intended to limit the scope of the present invention.

It must be noted that as used herein and in the claims, the singular forms "a," "and" and "the" include plural referents unless the context clearly dictates otherwise. Thus, for example, reference to "a pocket" includes two or more pockets; reference to "a panel" includes two or more panels, and so forth.

Where a range of values is provided, it is understood that each intervening value, to the tenth of the unit of the lower limit unless the context clearly dictates otherwise, between the upper and lower limit of that range, and any other stated or intervening value in that stated range, is encompassed within the invention. The upper and lower limits of these smaller ranges may independently be included in the smaller ranges, and are also encompassed within the invention, subject to any specifically excluded limit in the stated range. Where the stated range includes one or both of the limits, ranges excluding either or both of those included limits are also included in the invention.

As used herein, the term "substantially vertical" refers to an orientation with respective to the vertical of an angle varying by no more than about 20 degrees. The terms "substantially vertical" and "vertical" will be used interchangeably, unless clearly indicated otherwise. For example, when an angular measurement relative to the vertical is described, it is with respect to an unvarying vertical orientation.

As used herein, the term "angled" refers to an acute angle θ of from about 15 degrees to about 90 degrees relative to vertical, unless otherwise specified.

As used herein the term "mesh" refers to a material made of a network of wire or thread, having a spacing small enough to prevent passage of a propelled object at least one inch in diameter.

As used herein, the term "netting" refers to an open-meshed material made by weaving, tying, or knotting together twine, rope, wire, thread or the like. The "nominal string spacing" is measured for netting that is fully extended but not under tension. For typical netting designs with approximately square openings, this dimension corresponds to the width and height of each square.

As used herein, the term "unitary construction" refers to the property of being formed all in one piece.

As used herein, the term "rotationally mounted" refers to the attachment of wheels or ball rollers such that the wheels or rollers are free to rotate to facilitate movement in any desired horizontal direction.

As used herein, the term "caster" refers to any wheel or ball roller such that the wheel or roller is free to rotate to facilitate movement in any desired horizontal direction.

As used herein, the term "larger opening" refers to an opening with all dimensions at least twice the length of a standard sized football. Advantageously, the opening may extend the full width of the mobile practice target, so that all objects that reach the apparatus are captured for reuse.

As used herein, the term "smaller opening" refers to an opening with dimensions generally smaller than the "larger opening," e.g., the smallest dimension of the smaller opening is at least as large as the smallest dimension of a standard sized football.

As used herein, the phrase "capture and contain" means that objects that enter the mobile practice target through an opening must remain within the mobile practice target thereafter until deliberately removed to be reused. Objects must not bounce back out through the opening through which they entered, and must not fall out thereafter, whether through the same or another opening. Furthermore, such containment must occur with high probability (greater than 90%) for the maximum speeds at which objects are likely to traverse (pass through) the opening. Containment for objects traveling at very low speed is not sufficient, as such would not meaningfully allow for use of the mobile practice target by serious athletes who can be capable of throwing footballs at speeds in excess of 60 mph.

As used herein, the term "space-frame" refers to a structure typically made of rod or tube, not directly attached to the vertical and angled supports, which nevertheless provides structure to hold the resilient material in a desired configuration with respect to itself. The space-frame is used to control the interior three dimensional volume defined by the pocket (e.g., to hold the pocket in an open position so that the netting is not collapsed or folded onto itself) and may be physically located either inside or outside the pocket. The resilient material from which the pocket is made may be draped or stretched over the space-frame, and it may optionally be fastened to the frame at strategic locations.

The invention includes a mobile practice target for thrown, hit, kicked or otherwise propelled objects, and methods of using the same. The mobile practice target improves on practice devices of the prior art by using a construction configuration that more usefully approximates target zones used in actual play and allows the practice and development of skills that are faithful to the skills required in actual play.

The mobile practice target generally comprises (a) a framework comprising a base support and at least one substantially vertical support extending above said base support and an angled support associated with said substantially vertical support, wherein said angled support is at an angle of from about 15 degrees to about 90 degrees relative to the substantially vertical support, (b) a means for capturing an object propelled at the mobile practice target, and (c) a mobility means associated with the base support to facilitate transport of the mobile practice target. In preferred embodiments, the angle of the angled support is between about 30 degrees and 75 degrees relative to the substantially vertical support.

The framework can comprise a base support of any suitable shape, such as one or two spaced apart members, for example, an H-shaped, U-shaped or O-shaped base support, optionally connected via a connecting member. In yet other embodiments, the framework can further comprise two substantially vertical supports extending above said base support, and having a bend at the upper ends thereby forming the angled support associated with the substantially vertical support. Preferably the angled support is securely associated with the vertical support, and can be formed as one unitary piece or bolted together, for example.

In an additional embodiment, the framework can comprise a base support of one or two spaced apart members connected via a connecting member, and a single substantially vertical support extending above said connecting member and having an angled support associated therewith via a two pronged cross-member attached to the vertical support and oriented at an angle of from about 15 degrees to about 90 degrees relative to the substantially vertical support.

The means for capturing an object propelled at the mobile practice target is provided by utilizing a pocket formed from a resilient material for containing the propelled object and having at least one opening for receiving the propelled object into the pocket. The resilient material preferably can be removably attached to the vertical support and the angled support, meaning that the material can be secured or removed from the supporting framework as desired. In preferred embodiments, the pocket formed from the resilient material comprises an opening for receiving a propelled object from the horizontal direction and further comprises an opening for receiving a propelled object from above. In particular embodiments, the opening can be provided from above via the angled support, and can further comprise an opening from the front of the target, wherein the front is completely open, e.g., there is no vertical panel of resilient material. In this embodiment, the target could be more useful for beginners whose throwing or kicking accuracy is poor, while additional targeting lines or target images used in the front would be helpful to improve the usefulness of the target for more advanced players.

In additional embodiments, the means for capturing an object propelled at the mobile practice target further comprises resilient material in the form of a vertical panel having an opening formed therein for receiving a propelled object from the horizontal direction. In further embodiments, the means for capturing an object propelled at the mobile practice target further comprises a baffle, which can serve to absorb the momentum of the propelled object or deflect the object downward into the pocket.

In preferred embodiments, the mobile practice target can be adjusted in height, by for example, providing a vertical support with adjustable length dimension, e.g., telescoping tubing or movable frames. The framework can be constructed from a material selected from metal, wood, plastic, graphite or carbon fiber or the like, ceramic, resin, or composites thereof, and includes such materials as Plexiglas, resins, or fiberglass. Preferably, the construction materials used for the framework are no heavier than necessary to provide sufficient structural strength to withstand the repetitive practice of the user(s). In some instances, it may be desirable to include perforations in framework materials to reduce weight and enhance the mobility of the practice target.

In an additional embodiment, the framework further comprises an additional framework element connecting the two distal ends of the framework. In yet another embodiment, the framework further comprises at least two additional framework elements connecting the two distal ends of the framework to the base support, or combinations of these additional frame elements.

The resilient material can be any material suitable for forming mesh, netting or cloth, and can be comprised of string, cord or wire comprising a manmade or natural material such as a natural polymer, a synthetic polymer, glass, ceramic, graphite or carbon fiber or the like, or metal, or mixtures or composites thereof. Synthetic polymers that can be used include any polymers known in the art, and typically include nylon, vinyl, polyester, and the like. Netting material of varying weights and nominal spacing between strings can be used. In one embodiment, netting material with a nominal spacing between strings of about 3-5 inches is used. Such a spacing minimizes weight, cost, and wind resistance while being small enough to contain a football. Experiments have shown that smaller spacings of less than about 2 inches result in a target device that can be blown over or pushed around by moderate winds, while target devices built with netting having 4-inch spacing between strings are stable under most typical wind conditions.

In another embodiment, a mobile practice target is provided, comprising: a framework comprising a base support and a substantially vertical support extending above said base support and an angled support attached to said vertical support, a target panel comprising at least one pocket for receiving a propelled object attached to the vertical support and the angled support, and a mobility means.

The mobile practice target further comprises mobility means associated with the base support to facilitate transport, and so that the target can be easily moved about to change the position of the target relative to the individual for whom the practice is intended, and to simulate play conditions. The mobility means typically includes a means for decreasing the friction between the framework and the underlying surface, or enhancing the horizontal movement of the target. The mobility means can comprise any mechanism or device that provides freedom of movement with respect to the supporting surface, typically horizontal movement. Preferred mobility means include wheels, runners, ball rollers, or compressed air. Preferably, the mobility means comprises three or more wheels rotationally mounted to the base support. In additional embodiments, the mobility means comprises two cambered wheels and one or more casters. Additional aspects are discussed below.

In another embodiment, the mobile practice target further comprises targeting lines or a target image placed to guide a user in targeting the propelled object to one or more precise targets.

In yet another embodiment, the mobile practice target further comprises an additional opening for receiving a propelled object from the horizontal direction. It is preferred that the additional opening be located at a location convenient for a football center to practice the center snap. However, other alternative openings will be readily envisioned by the user and are included within the scope of the invention.

In an additional embodiment, a mobile practice target is provided comprising (a) a substantially vertical panel comprising a resilient material and having a support means secured to a base and at least one opening located within the panel for receiving a propelled object; (b) an angled panel comprising a resilient material and capable of receiving a propelled object and having support means securing the angled panel at an angle of from about 15 degrees to about 90 degrees relative to the substantially vertical panel; and (c) mobility means to facilitate transport of the mobile practice target. The substantially vertical panel and the angled panel can have any suitable shape, such as a circular or oval shape or a shape in the form of a polygon having at least three sides, and more preferably having four sides. The substantially vertical panel is oriented at an angle varying by no more than about 20 degrees from the vertical.

As described above, the support means can be constructed from any suitable construction material, and generally comprises metal, wood or wood containing construction material (e.g., a wood laminate), plastic, graphite or carbon fiber or the like, glass, ceramic, resin, or composites thereof. The substantially vertical and angled panels preferably comprise cloth, mesh or netting, or combinations thereof. The mobility means preferably comprises wheels, runners, ball rollers, or compressed air. The panels can be of a unitary construction with a front or vertical panel and an angled panel that are integral with each other, or can be separate. The panels can be integral with or attached to the support means using any means known in the art (e.g., rope, ties, Velcro, elastomeric connectors, hooks, snaps, and the like). The front panel can be provided with a centrally located pocket and the angled panel can be provided with a centrally located pocket or the angled panel can itself function as a pocket, providing a pocket with the maximum sized opening. The vertical and/or angled panels can be made elastic or resilient to rebound any ball or game object that does not enter the pocket, and preferably absorb the kinetic energy of the thrown or propelled object so that on rebounding, the object falls near the mobile practice target.

The resilient material comprises at least one pocket or forms at least one pocket that is generally centrally located on the target panel, or in the space between the two substantially vertical members. However, two or more pockets can be present if desired. In a more preferred embodiment, the pocket formed by the resilient material is smaller in area than the space across the two substantially vertical members and the pocket in the angled portion of the two substantially vertical members encompasses the entire width of the space between the angled panel support means or the vertical members forming an angled portion at the upper end of the vertical members. In a particular embodiment, the substantially vertical panel and the angled panel are constructed of one piece and placed across the two substantially vertical members having a bend and forming an angled portion at the upper end thereof, forming the panels thereon, and can be secured using any means known in the art (e.g., rope, ties, Velcro, elastomeric connectors, hooks, snaps, and the like). In a preferred embodiment, the panels can be secured using anchor points and rope, for example.

In another embodiment, a mobile practice target is provided comprising: a framework of two substantially vertical members having a bend and forming an angled portion at the upper end thereof extending above a base support of two spaced apart members, wherein the angle of the bend is between about 15 degrees and 90 degrees relative to the two substantially vertical members; a resilient material placed across the two substantially vertical members having at least one pocket located therein for receiving a propelled object, a resilient material placed across or around the angled portion of the two substantially vertical members having at least one pocket located therein for receiving a propelled object; and means for mobility. In certain embodiments, the angle of the bend is between about 30 degrees and 75 degrees relative to the two substantially vertical members. The means for mobility typically comprises wheels, runners, ball rollers, or compressed air, and when the mobility means comprises wheels, at least two wheels are rotationally mounted to the base support.

In a preferred embodiment, the support means comprises a framework of two substantially vertical members having a bend and forming an angled portion at the upper end thereof extending above a base support of one or two spaced apart members, wherein the angle of the bend is between about 15 degrees and 90 degrees relative to the two substantially vertical members. In more preferred embodiments, the angle of the bend is between about 30 degrees and 75 degrees relative to the two substantially vertical members. In another preferred embodiment, the angle is about 55 to 65 degrees relative to the two substantially vertical members. Typically, the angle is bent to the rear with respect to the opening provided for the pocket on the substantially vertical panel.

The framework can include an additional framework element connecting the two uppermost ends of the vertical members of the framework. In additional embodiments, the framework can further comprise additional framework elements connecting the two substantially vertical members of the framework to the base support. The framework can be provided in separate pieces that can be assembled or disassembled into the framework.

In an additional embodiment, a mobile practice target is provided comprising a base of two spaced apart members supporting at least one vertical member forming a front and having a bend towards the back at the upper ends thereof forming an angled portion with respect to the vertical member, and means for capturing a propelled object entering the angled portion or the front of the practice target. Preferably, the means for capturing the propelled object is a portion of resilient material in the form of a funnel, a flat sheet, a flat sheet with an opening, a pocket contained within the resilient material, or combinations thereof.

In any of the above described embodiments, it is preferred that the framework be adjustable in height, for example, by adjusting the length of the substantially vertical members. In a preferred embodiment, the adjustable framework is a telescoping framework. However, the entire framework can be of unitary construction if desired. The framework can include rectangular, L-shaped, round and/or elliptical members formed so as to be press fit together, and can be anchored in place where necessary using conventional means. In another embodiment, the framework can be connected together using rectangular, L-shaped, round or elliptical members that can be joined together using any means known in the art (e.g., L-shaped pieces). The framework can also be formed in sections with the intersections of the target framework being structured so as to be joined together and removed by pressing and pulling. Elastomeric connectors can be provided through openings in the framework to facilitate assembly and disassembly, such as are commonly used in the framework of portable tents.

In any of the above described embodiments, the mobility means can include any device or apparatus that can be used to reduce the friction of movement between the practice target and the ground or floor or other substantially horizontal surface on which it is being used. Typical mobility means include wheels, but can also include other members capable of sliding or rolling across a surface such as runners or ball rollers, etc. The mobility means can also include compressed air to elevate the practice target off of the direct contact surface. When the mobility means is provided using wheels, generally at least two wheels and preferably three wheels are utilized and the wheels are rotationally mounted to the portion of the mobile practice target in contact with the ground so as to provide greater directional freedom of movement for the mobile practice target. There is no particular limit to the number of wheels that can be included as the mobility means for the practice target, and the number of wheels is determined by the particular needs of the user, the type of surface on which the target is to be used, the amount of mobility and speed that is desired, and so forth.

When the mobility means is provided by compressed air, an air compressor can be remotely located and compressed air supplied by means of a tube to the compressed air outlets placed between the bottom surface of the practice target and the direct contact surface (the ground or floor). Alternatively, the mobile practice target can further comprise an air compressor and battery or fuel cell (or a power cord to a source of electricity) to provide compressed air to the compressed air outlets placed between the bottom surface of the practice target and the direct contact surface.

The motion of the mobile practice target can be provided by a vehicle, a motorized assembly, or by an animal, including a human, assistant. In a typical use, a team member or coach or other assistant can grasp the practice target and move it about a playing field or floor of a practice room (e.g., a gymnasium) to provide the motion necessary to simulate dynamic play. The mobile practice target can further comprise graspable appendages or handles to facilitate the grasping and manual movement of the target by the human assistant. In addition, a rope or chain can be attached, and the mobile practice target can be moved about by an animal or vehicle pulling on the rope or chain.

In one embodiment, the mobility means can comprise two wheels, and a third leg optionally provided with a slidable member (e.g., a runner) is provided for stability and balance. In use, the human assistant lifts the third leg from contact with the ground and rolls the mobile practice target about as desired, while the individual for whom targeting practice is provided throws, lofts, kicks or otherwise propels the desired objects toward the target pockets.

A motorized assembly can also be included as a portion of the mobile practice target, providing for motion of the target using a simple or complex algorithm describing that motion. Thus, the motorized assembly can provide for a linear motion of the mobile practice target, such as traversing the playing field at a steady rate of speed for a defined amount of time or distance. The motorized assembly can also include a programmed set of motions approximating the movements of a game participant. The movements can be simple or complex movements, such as running a play.

In an additional embodiment, mobility of the practice target can be provided by other external means, such as by placing the practice target on a cart pulled about by a vehicle, or directly on a vehicle, preferably a small vehicle such as a golf cart. In certain embodiments, the practice target can be stably mountable on the cart or vehicle, using conventional means such as clamps or bolts, for example.

Also provided is a method of improving the ball placement skills of an individual utilizing the mobile practice target. The ball placement skills can be improved by the practice of propelling a ball or other game object into the pocket of the substantially vertical panel and/or the pocket of the angled panel. In alternative embodiments, the individual propels a ball into the opening for receiving a propelled object from the horizontal direction or the opening for receiving a propelled object from above. The mobile practice target can be used with optional target lines and/or target image(s) for honing particular ball placement skills. In addition, the mobile practice target can be used in motion or at rest.

According to one or more embodiments of the present invention, a target image of a football player is positioned at the back of or behind the pocket, and adjustable vertical target lines are positioned across the front opening. These target lines are thus positioned a few feet in front of the target image.

Target lines can be used to aid in practicing specific throwing skills. A single target line can be used to define left and right regions to practice throws to the left or right half of a receiver image. Together with the target image, two target lines can form a "target tunnel." This target tunnel can be used, for example, to practice various running throws where an individual releases the ball just as he arrives at a point where the target image is centered between the target lines. The target lines can be set near the edges of the opening to provide a wider target tunnel for beginners, and as the player's skill improves, the target lines can be positioned closer together. The adjustable spacing can also be advantageous for practicing throwing "down the line" from a standing position by simultaneously providing a realistic receiver image and a target width that matches the individual's training needs at any particular distance from the target. Another use for the adjustable target lines is for practicing field goal or point-after-touchdown kicks. The target lines can be set to a spacing which simulates the spacing between goal posts by creating the same target angle from the kick point. Four target lines can be provided to set two spacings without adjustment.

The target lines can be constructed from any convenient material. Examples include, but are not limited to, wire, cord, rope; cotton, nylon, or polypropylene webbing; plastic or rubber tubing; and the like. Rigid materials such as tubing and pipe are also possible. Materials such as nylon or polypropylene webbing in a suitably bright color can provide an advantageous combination of visibility, durability, and "give" to allow footballs which hit the target lines to continue into the pocket.

The mobile practice target is also useful in a method for practicing game skills under simulated game conditions. The mobile practice target can be used when in motion or at rest, and allows an individual to practice game skills under simulated game conditions, in which the individual propels a game object into the pocket of the substantially vertical panel, the pocket of the angled panel, or both pockets of the mobile practice target while the mobile practice target is in motion or at rest. In an alternative embodiment, the method for practicing game skills comprises propelling a game object into the opening for receiving a propelled object from the horizontal direction, the opening for receiving a propelled object from above, or both, while the mobile practice target is in motion or at rest. The mobile practice target can be used with the participation of at least one additional game player, and can be used to simulate game conditions.

The use of the practice target facilitates training and refinement of ball placement skills and allows for more facile observation and input from coaches or other observers. The practice target improves on practice devices of the prior art by providing devices and methods for training individuals such as quarterbacks in the game of football for quick decision making as well as throwing accuracy, and is useful for training under simulated game conditions requiring rapid adjustment in throwing strategy, distance, aim and power to an intended target capable of motion. The practice target is also useful for facilitating repetitive throwing, kicking or other propulsion techniques, as the ball or other game object is captured without the assistance of additional players. The practice target is also particularly useful for coaches who are able to closely watch the individual to be trained from any angle without being distracted by having to catch the ball or other object propelled toward them, while simultaneously being able to judge the accuracy of the throw by its presence inside or outside the intended target pocket, its location within the pocket (e.g., left side, right side or center), passage by the targeting lines (without hitting the lines) or passage through the intended target image.

In particular embodiments, the mobile practice target offers the following advantages over the prior art: rapid assembly and/or breakdown, easy transportation from home to vehicle to practice field, adjustable to different heights for different sizes of players or different uses, useful for teaching different targeting and/or ball placement skills, facilitates coaching and evaluation of a player's form, and utilization indoors or out. In addition, the practice target is easily assembled and disassembled. The practice target can be formed from a frame constructed from metal or light-weight plastic that can be easily press fit together for easy assembly and disassembly. The panels or netting can be formed of a unitary construction if desired with a front or vertical panel and angled panels that are integral with each other, or can be separate. Any additional forms of the resilient materials, such as the funnel or pocket shaped embodiments, can also be made of unitary construction. The resilient material can be integral with or attached to a vertical support means using anchor points and rope.

Referring now to the drawings, FIG. 1 illustrates an embodiment of the invention, where 11 and 12 refer to the substantially vertical panel and angled panel, respectively. Base 16 provides support for the support means 13. The vertical panel 11 has a top 19 and an opening 26 to at least one pocket 18 located within the panel for receiving a propelled object, an angled panel 12 having angled support means 14 securing the angled panel at a bend 15 and at least one pocket, here shown as coextensive with the panel itself 12, for receiving a propelled object; and mobility means 20 to facilitate transport of the mobile practice target. The opening 26 can include markings or structural support 17, and includes netting or mesh or cloth forming the pocket 18 and capturing the propelled object therein.

Figure 2:
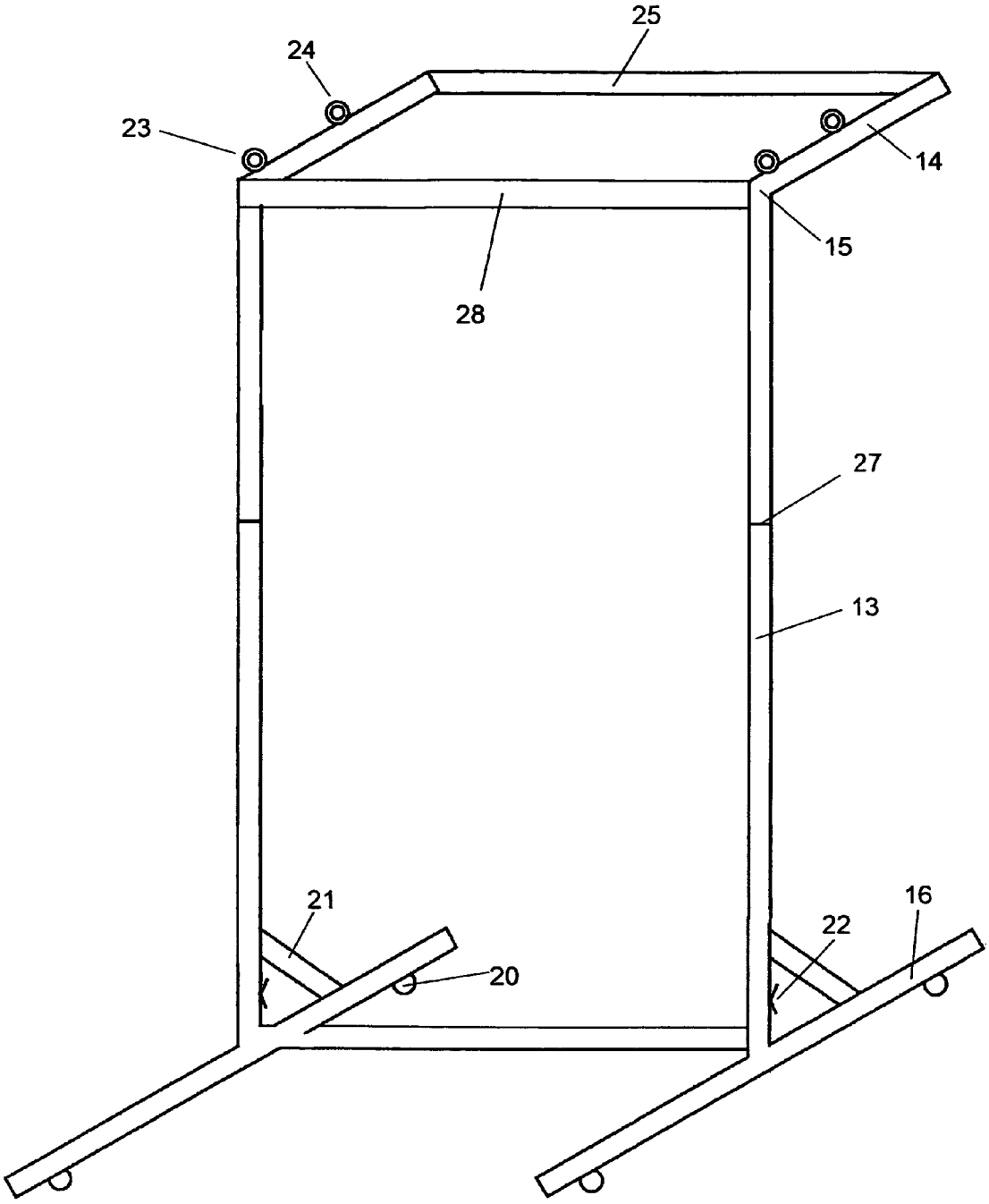
FIG. 2 illustrates one embodiment of a frame of the mobile practice target.

FIG. 2 illustrates a representative frame useful in an embodiment of the invention. Base 16 provides support for the support means 13 and 14 securing the angled panel at bend 15 and mobility means 20 to facilitate transport of the mobile practice target. The frame can further comprise optional cross supporting members 25 and 28, and can comprise optional additional supporting means extending from support means 14 to base support 16. A telescoping frame is indicated at 27, providing adjustability to the length of the vertical support, and thus the overall height of the practice target. The frame can further comprise optional structural support 21, and optional anchor points 22, 23 and 24 for securing the panels onto the frame. Additional anchor points can be disposed about the frame in convenient locations as desired.

Figure 3:
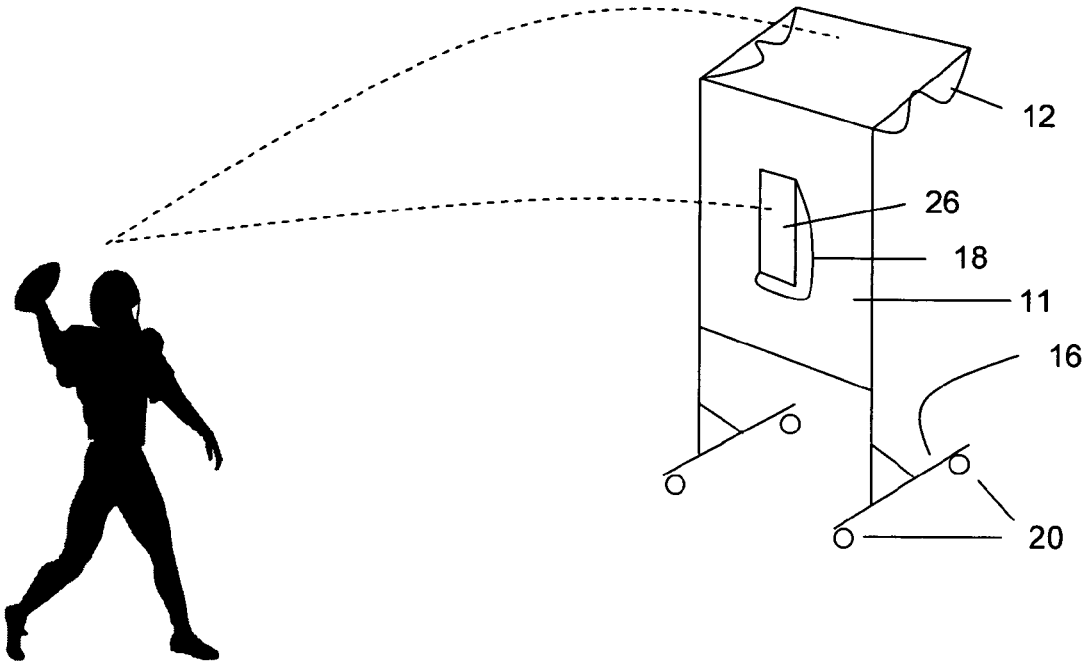
FIG. 3 illustrates schematically how the mobile practice target is used in the training of an athlete.

With reference to FIG. 3, a player is shown in training using one embodiment of the mobile practice target. Base support 16 having wheels for mobility is shown with vertical panel 11 and opening 26 to pocket 18, and angled panel 12 having an integral pocket. The angled panel is shown gathered and attached to the angled support using an anchor point to form the pocket. The player is shown in the process of throwing a football with intended horizontal and arcing trajectories into the pocket integral with the vertical panel and the angled pocket, respectively.

Figure 4:
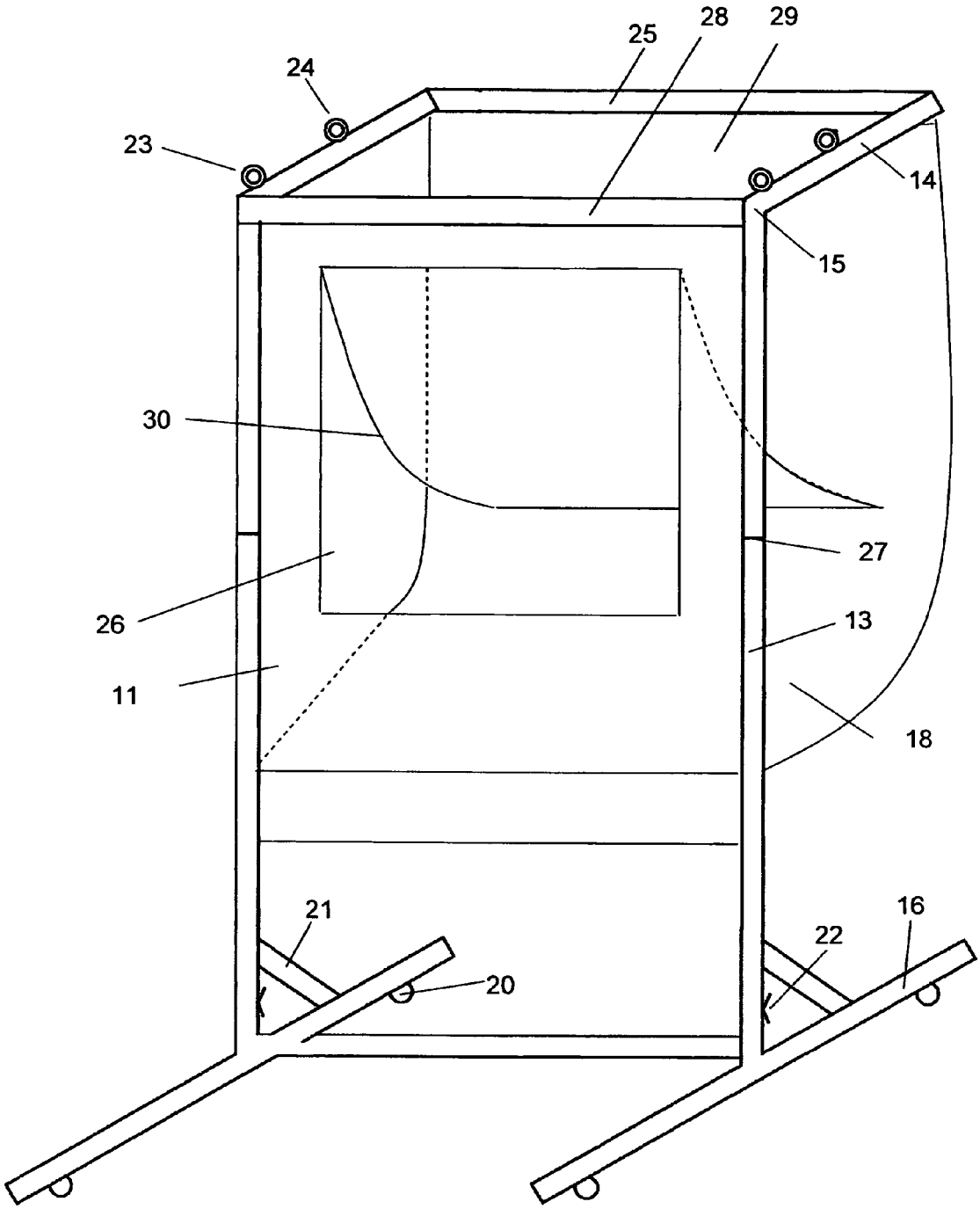
FIG. 4 illustrates an alternative embodiment of the mobile practice target.

FIG. 4 shows a preferred embodiment for the mobile practice target, illustrating a preferred means for capturing an object (e.g., a football or soccer ball) propelled at the mobile practice target. The resilient material is shown forming vertical panel 11 having an opening 26 in the front of the target leading to pocket 18. Opening 26 is shown occupying part of the width of vertical panel 11, but in certain embodiments it can extend the full width of the panel. It can also extend for most of the vertical height as well. Opening 29 for receiving propelled objects from above (e.g., from an arcing or lofting throw or kick) is shown between the angled support members leading to pocket 18. Baffle 30 is shown formed from the three sided cut in the resilient material of vertical panel 11 forming the opening 26. The baffle is preferably secured (e.g., using ties or snaps) at the corners to the back surface of the pocket 18, and allows the ball to fall in the unsecured space between the corners. The baffle acts to slow the ball and direct its movement into the bottom of the capturing pocket 18. Pocket 18 preferably further comprises sides (not shown) for more effectively capturing the propelled object. The framework is shown formed from H-shaped base support 16, vertical support 13 and angled support 14, having bend 15 forming an acute angle between 15 and 90 degrees relative to the vertical, and having cross-members 25 and 28 and additional support members 21 for added strength and stability, which are optional. The joint between telescoping frame members is indicated at 27 as an exemplary method of adjusting the overall height of the target. Additional optional anchor points 22, 23 and 24 for attaching the resilient material used for capturing the propelled object are indicated, and can be present at any suitable location on the frame if desired. Optional targeting lines (not shown) can be placed (e.g., tied or hooked) onto cross-member 28 so as to hang at the desired sites within the opening 26. For example, two targeting lines can be hung over the opening 26 to simulate dividing the opening into thirds for targeting precise locations within the opening. Another option is to place a target image (not shown) (e.g., a fabric having cutouts of desired ball placement targets, or showing the silhouette of a game player to receive the object) over the front of the vertical panel 11. A player can practice more precise targeting skills by throwing or kicking the ball at precise locations on the targeting image or between specific targeting lines to hone ball placement skills.

Figure 5:
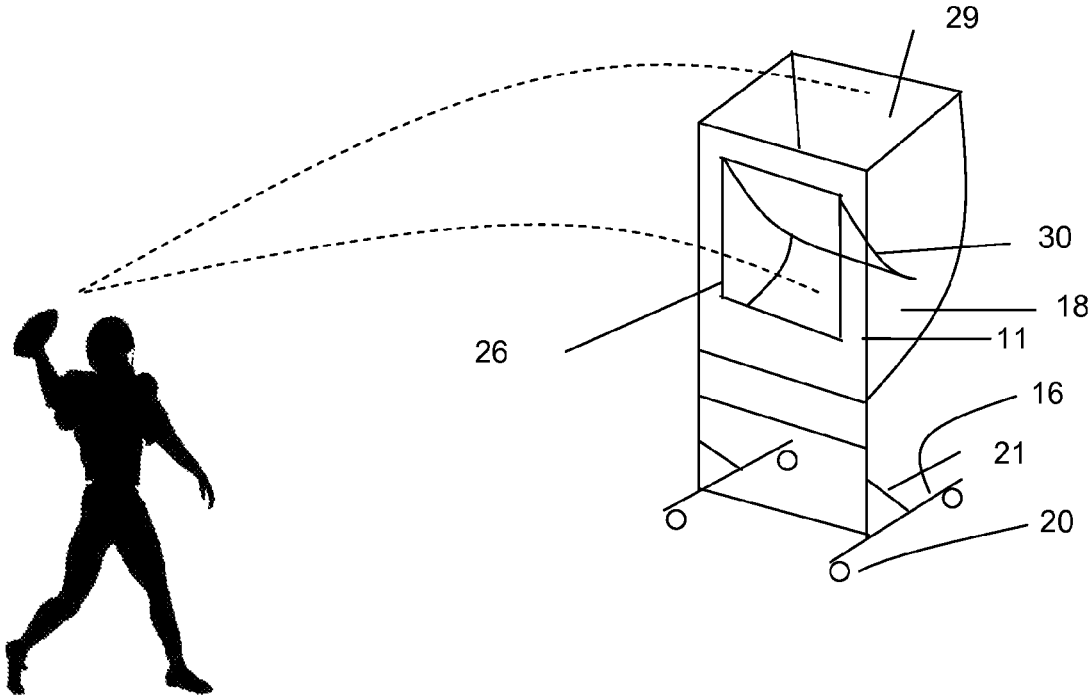
FIG. 5 illustrates schematically how the mobile practice target is used in the training of an athlete.

FIG. 5 illustrates a player training using an alternative embodiment of the mobile practice target. Base support 16 having wheels as mobility means 20 is shown with optional structural support 21. The practice target is shown with vertical panel 11 having an opening formed therein for a propelled object 26 and for receiving the object, pocket 18, and an opening for receiving a propelled object from above 29. Targeting lines or a target image can be present if desired, and will usually be placed in front of the opening 26 formed therein for a propelled object. A portion of resilient material is shown forming pocket 18 for capturing the ball, and a baffle 30 is shown formed from the opening cut in the vertical panel 11. An optional left and right side are not shown, but serve to capture the propelled object more securely. The baffle is secured at the corners to the back surface of the pocket 18, and allows the ball to fall in the unsecured space between the corners. The baffle acts to slow the ball and direct its movement into the bottom of the capturing pocket. The player is shown in the process of throwing a football with intended horizontal and arcing trajectories into openings 26 and 29, respectively. However, it will be understood that the practice target can be utilized for other methods of practice, for example, center snaps and place kicking in football, heading and passing in soccer, spiking and passing in volleyball, passing and shooting on goal in lacrosse, and the like.

Figure 6:
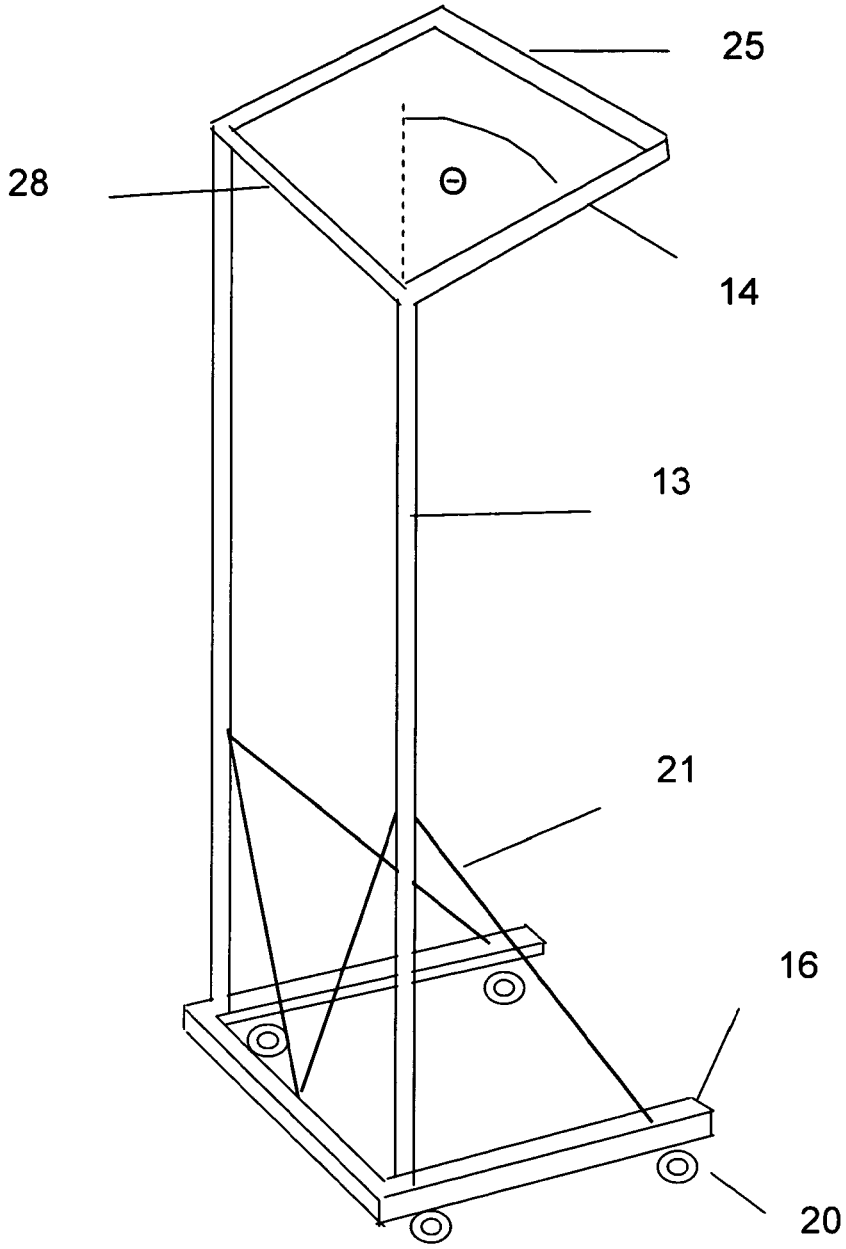
FIG. 6 illustrates an alternative embodiment of a frame of the mobile practice target.

FIG. 6 illustrates an alternative embodiment of a frame useful in constructing the mobile practice target. The base support 16 is shown in the form of a U-shape having as mobility means 20 four wheels. Base support 16 can be of one piece or unitary, or can be formed of separate pieces and assembled. The angle between the vertical support and angled support is shown as θ. Optional additional supporting members 21, 25 and 28 can be used to provide additional stability. A cross member 28 is shown at the junction of the angled support 14 and the vertical support 13, and cross member 25 is shown across the uppermost ends of the angled supports 14.

In a preferred embodiment, the width of the base can be from about 36" to about 44" and the height of the vertical support can be from about 74" to about 90", though smaller or greater heights are possible. The angled support can be about 30" in length, and as shown is placed at an angle of between about 55 degrees and about 75 degrees from the vertical. The dimensions can be chosen (shorter or taller, wider or narrower) so as to fit the size of the player and/or use intended. In addition, the particular angles for the angled support can be chosen to suit the intended purpose for the practice target. Mobility means can be chosen to suit the environment of use. Wheels or ball rollers typically will be the preferred mobility means, but for use in snow, the wheels could be replaced with a sliding mobility means such as sled runners.

The mobile practice target can be used when in motion or at rest, and allows an individual to practice game skills under simulated game conditions, in which the individual propels a game object into the pocket of the substantially vertical panel, the pocket of the angled panel, or both pockets of the mobile practice target. The mobile practice target can be used with the participation of at least one additional game player, and can be used to simulate game conditions.

The mobile practice target can also be used under immobile conditions, and can include a means for anchoring the practice target to a stationary position, for use in circumstances where mobility is to be minimized or for use in a permanent or semi-permanent location. Such means for anchoring can include ties, hooks, or the like to attach the target to an anchoring point on or in the ground or stakes for providing immobility.

The practice target can be conveniently manufactured and assembled from a light-weight round or rectangular or elliptical tubing of metal or plastic, for example, having round or rectangular or elliptical inserts. The framework supports a panel in an essentially vertical position for receiving objects from a substantially horizontal direction and an angled panel for receiving objects having an arcing trajectory or from above. The edges of the panels can be attached to the framework by means of removable or releasable fasteners. The target can be used from the front or from the rear as well, and the pockets can be inverted if desired to receive objects propelled from the rearward side of the practice target.

The mobile practice target can be colored to provide greater visibility for the individual to be trained. The pocket region and/or the area abutting the opening to the pocket can be similarly colored or contrastingly colored so as to highlight the target area. In addition, a target image can be included, such as a facsimile resembling a team-mate or other game participant. The pocket can be constructed so as to be transparent to the eye or opaque.

Figure 7A:
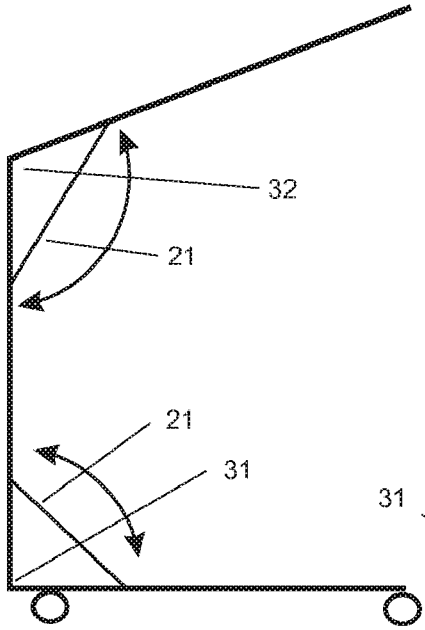
FIG. 7*a-c* illustrate an alternative embodiment of a frame of the mobile practice target with hinges.
Figure 7B:
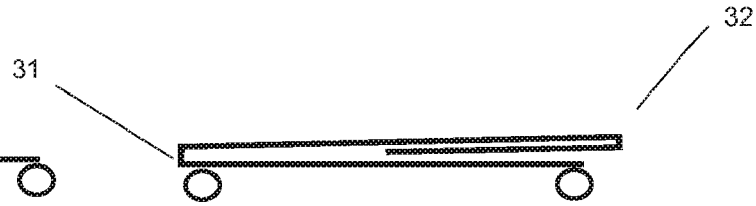
Figure 7C:
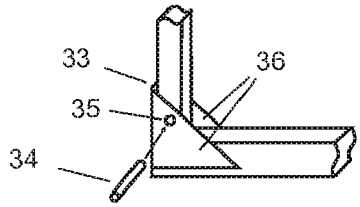

The mobile practice target may further incorporate a set of hinges and locking mechanisms to improve portability. FIG. 7 illustrates one embodiment of a framework for a mobile practice target which incorporates such hinges and locking mechanisms. The vertical support members are connected to the base members by hinges located at hinge point 31, and the angled support members are connected to the vertical support members by hinges located at hinge point 32. When folded (FIG. 7*b*), the vertical and angled support members lie approximately flat against the base making a compact structure for carrying, transporting and storage. In use (FIG. 7*a*), the vertical and angled supports are opened to the appropriate positions and secured in place. Any common means of setting the open position can be used. FIG. 7*c* illustrates one example in the form of stops 33 which limit the angle to which the supports can be moved. The open position can then be secured with pins 34 or similar devices. Multiple holes 35 in the side plates 36 can be used to set varying angles for the angled support. Additional structural support members 21 can also be provided (e.g., struts), in which case, the angle can be made adjustable either by making the length of the support member variable or by providing alternative locations for securing one or both ends of the support member. Gas springs may also be added for safety in place of or in addition to structural support members 21 so that the angled supports and/or vertical supports cannot suddenly collapse and injure a person erecting or stowing the mobile practice target. When support members and gas springs are both present, the gas springs can be positioned adjacent to the support member on the interior or exterior of the target, e.g., on the interior or exterior of the pocket 18.

Figure 8:
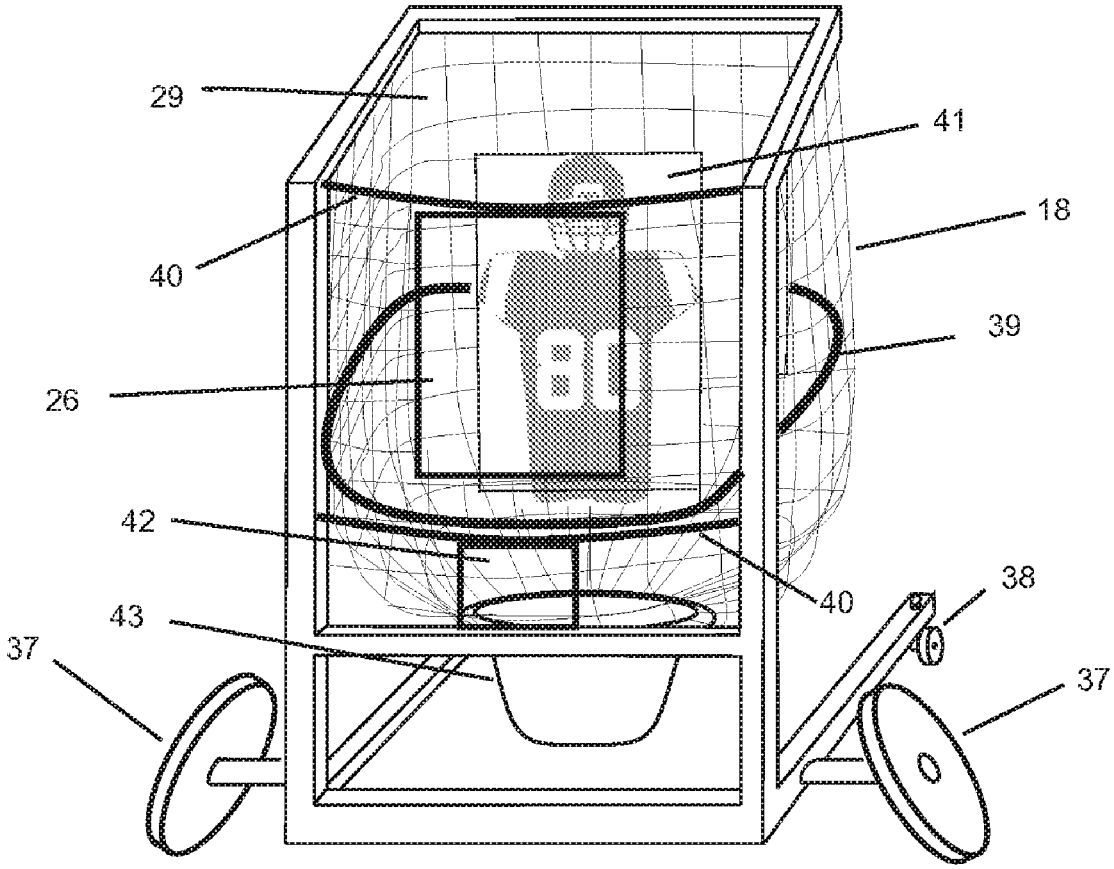
FIG. 8 illustrates an alternative embodiment of the mobile practice target with cambered wheels, a space frame, two front openings, a player image, and a propelled object collection container.

In a further embodiment of the mobile practice target, cambered wheels 37 are used for two of the wheels as shown in FIG. 8. Such cambered wheels can greatly improve stability of the mobile practice target without the need for adding weight to the base to lower the center of gravity. With cambered wheels, should the mobile practice target tip due to wind, user error, or an unusually strong impact from a thrown object, it is much more likely to self-correct and return to the vertical position that it would be with ordinary parallel wheels. Various wheel sizes and configurations are possible. In a preferred embodiment, the two front wheels 37 are 8-10 inches in diameter and tilted inward at a fixed angle of about 30-45° from the vertical. Typically, there are two rear wheels 38 which are freely swiveling as casters, although the number of such additional support wheels or rollers may vary from one to three or more. Between the energy absorbing characteristics of the baffle and pocket materials and the stability provided by the cambered wheels, the mobile practice target can be used to receive footballs arriving at up to about 100 mph without the need to secure the mobile practice target to the ground or to otherwise hold it in place to prevent it from falling over.

Several additional features can be seen in this embodiment of FIG. 8. A space-frame 39 provides additional support for the netting attached to the vertical and angled supports to form the pocket 18. This frame is typically inserted after the netting is attached to the supports. The netting may be secured to the space-frame components by a series of clips, or a tube or set of tube segments, preferably made from a sturdy fabric material may be sewn to the netting to provide a means for connecting the netting to each space frame component. The space-frame provides additional structure to hold the netting in a desired configuration.

Similar in concept to the space-frame, an alternative means of supporting the shape of the pocket 18 can be provided by using one or more sturdy elastic cords 40 strung between vertical or angled support members.

Several specific target features are illustrated in FIG. 8 for various training applications. An image or silhouette of a football player 41 can be mounted to the back surface of the receiving pocket 18. This image can provide a realistic target receiver. For passing practice, a relatively large opening 26 can be provided in the front of the mobile practice target opposite the image or silhouette. For center snap practice, an additional smaller opening 42 can be provided below the main opening. For training of lofting throws, the mobile practice target can provide a separate opening 29 in the top.

In order to facilitate efficient use of the mobile practice target, it is important to maximize the number of throws that can be made in a given period of time. The embodiment of FIG. 8 shows a large plastic bucket 43 in receiving relationship to the bottom of the pocket 18. In other embodiments, the bucket may be replaced with a fabric or net bag. Balls which are successfully captured by the mobile practice target fall into this bucket or bag. One bucket can hold 10-15 footballs and can be rapidly swapped out for a second empty bucket. Either the thrower or an assistant can make the bucket swap at periodic intervals, and the time wasted retrieving balls or emptying the target pocket can be minimized. In typical use, a person practicing passing throws may throw up to about 150 passes in a 30-minute practice session.

Use in Training of Athletes

The mobile practice target of the invention is particularly useful in training athletes to improve their throwing, kicking, passing skills, and the like, and allows the trainer to focus his attention and instruction on the athlete's style and form outside the dynamic conditions of play, while simulating the dynamic conditions of play. The mobile practice target can be used by a player alone, or with a trainer, or in combination with additional players simulating game conditions. For example, the mobile practice target can be used to improve the kicking and passing skills of athletes playing soccer, football, rugby, lacrosse, field hockey, ice hockey, basketball, tennis, Frisbee, as well as any other sport involving the propulsion of an object into either a goal or a team member's possession.

The mobile practice target is particularly useful for training athletes in the skills required for effective passing or shots on goal in soccer, basketball, lacrosse, field hockey or football. For example, the mobile practice target is useful for training soccer players in throw-in, short pass or long pass techniques by kicking or throwing the ball into the pocket of the vertical panel, or "heading" the ball (striking the ball with by contacting the ball with the player's head) over an opposing team player, causing the ball to enter the pocket of the angled panel. Similarly, the mobile practice target is useful for training athletes in the passing or shots on goal of a smaller object such as a lacrosse ball.

The mobile practice target can be used from either the front, i.e., facing the substantially vertical panel, or from the back, i.e., facing the back side of the pocket contained within the substantially vertical panel. When used from the back, the vertical and angled panels provide a useful arresting mechanism for objects propelled forward and/or upward, such as when practicing kicks.

The mobile practice target is also mobile and thus capable of motion while the player propels an object at the target. The player can use the mobile practice target alone in a static mode, and practice propelling objects at the target while it is stationary. The player can also use the target alone in a dynamic mode by setting the practice target on an incline for spontaneous movement, allowing the player to practice propelling objects at the target while it is in motion. A motorized assembly can also be included on the mobile practice target, providing for motion of the target using a simple or complex algorithm describing the movement The player can also use the mobile practice target while practicing with others in a static mode, or in a dynamic mode. The mobile practice target can be placed on an incline for spontaneous movement or can be propelled about or pulled with the aid of an assistant. In a motorized form, the mobile practice target can provide movement, simulating play conditions. Thus the mobile practice target allows for the training of quick decision making as well as accuracy in throwing, kicking or otherwise propelling objects during simulated playing conditions.

The practice target is also useful when used in multiples of two or more. When used in this manner, the player can propel game objects at one target and move switch to the other targets without having to retrieve the game objects and move back to the playing position, thereby improving the efficiency of practice time.

The practice target is also useful when used in the home or back yard environment.

Use in Football

The mobile practice target is useful in the training of all members of a football team, including the center, kickers, receivers, defensive and offensive linemen, as well as the quarterback. As shown in FIGS. 3 and 5, the opening 26 (e.g., using the pocket or opening in the vertical panel) can be used for targeting and capture of objects thrown horizontally or "driven," while the opening 29 (e.g., to the angled panel pocket 12 or pocket 18) can be used for targeting and capture of objects following an arcing path, or "lofted," first traveling upward and then downward into the target pocket. For improving the skills of the athlete playing center position, the center can be trained to throw into pocket 18 on vertical panel 11, or an optional center opening 42, or target indicated on a target image placed over opening 26 (not shown). An assistant or team member can move the mobile practice target to simulate the movement of the player receiving the center's pass at the initiation of a play, thereby facilitating the training of the center to adapt to the dynamic conditions of play. Alternatively, practice of center throws or "snaps" can be performed without the use of smaller center opening 42, by use instead of a simple "target" located below the large front opening. Such a target can be defined, for example, by extending the target lines below the large front opening to a cross member located about one foot below the opening. The center throws merely bounce off the resilient material of the front panel rather than entering the mobile practice target. Capture and containment is not necessary for such throws, because they are performed at very short distances.

Training a Quarterback

In a preferred embodiment, the mobile practice target can be used as a training device to refine and hone the throwing skills of a quarterback in the game of football. As indicated in FIGS. 3 and 5, in operation, the quarterback in training is instructed to throw the football into opening 26 to practice driven (horizontally thrown) throwing techniques and to throw the football over an imaginary or actual obstacle such as a blocker into opening 29 to practice lofted or arcing throwing techniques. In certain embodiments, the angled support can be positioned at a smaller angle such that the top edge is higher, simulating a blocker. For example, the angled support can be set to 0 degrees, i.e., vertical, to maximize the height of the obstacle.

Two practice targets can be advantageously used to practice "spot throwing" and to simulate training in choice of target, i.e., which receiver to throw to when one or more receivers are being put into play. The use of multiple practice targets is also very helpful to a quarterback in learning passing patterns in football.

In addition, using the mobility means, an assistant or team member can propel or move the mobile practice target, with or without warning, forcing the quarterback to rapidly reassess the target distance, angle of attack, throwing speed, etc., and make necessary adjustments to throwing technique or choice of target based on the changed conditions, thus simulating the rapidly changing conditions encountered on the field of play.

A total of at least twelve specific football training tasks can be implemented using the mobile practice target. These include:

1. Line pass or rope pass: this is the typical quarterback pass; the larger front opening in the mobile practice target is used together with the image of a football player on the back of the pocket. Throws can be practiced at varying speeds and distances, either from a standing position, or at the end of various specific movement patterns. Depending on the specific skill being practiced, the pass can be aimed at particular locations on the target image such as the left or right shoulder, the center of the chest, etc. The target lines can be used to provide a progressively narrower target "tunnel" as throwing skills improve.
2. Option toss or pitch: this is an underhand throw; the larger front opening is used.
3. Touch pass or lofted pass: the upper opening is used; the goal is to throw the ball over imaginary opponents to reach a receiver from above. Unlike other devices used for practicing lofting throws, embodiments of the present invention include a target image of a receiver, and lofted passes can be aimed precisely at particular locations on the receiver's body such as the left or right shoulder, the center of the chest, etc.
4. High release throw #1: this is a more extreme version of the lofted pass; typically a person is used as the receiver, but a second mobile practice target can also be used, and the thrower must loft the ball completely over the mobile practice target which is a total of about 8½ ft high.
5. High release throw #2: for even higher throws, the mobile practice target can be used at a suitable distance (e.g., 10 ft) from a goal post (10 ft high); the thrower must loft the ball over the goal post, aiming for either the larger front opening or the upper opening.
6. Hard pass or high velocity pass: in this case the ball is thrown as fast as possible at the larger front opening. The mobile practice target has been tested to capture and contain footballs that were machine-launched at speed of up to 100 mph. (Typical high school players can throw at speeds up to about 35 mph; college and professional players may throw at speeds up to about 70 mph.)

7. Center snap for punt: this is a "long" snap, and the larger front opening is used; the thrower aims for the numbers on the target image of a football player on the back of the pocket.
8. Center snap for field goal or PAT (point after touchdown): this is a "short" snap to the holder; the smaller front opening or target area is used.
9. Punt: this is a kick; the larger front opening is used.
10. PAT: this is also a kick; the larger front opening is used.
11. Field goal: this kick is longer and harder; the larger front opening can be used, or alternatively, the mobile practice target can be used as a simulated goal and the kicker can aim to get the ball over the top of the mobile practice target.
12. Kick off: this is a running kick; the larger front opening is used.

It is to be understood that while the invention has been described in conjunction with the preferred specific embodiments thereof, the description above is intended to illustrate and not limit the scope of the invention, and that various omissions, substitutions, equivalents and changes in the forms and details of the device illustrated and in its operation can be made by those skilled in the art without departing from the spirit of the invention as defined by the following claims.

The practice of the present invention will employ, unless otherwise indicated, conventional construction techniques and the like, which are within the skill of the art. Other aspects, advantages and modifications within the scope of the invention will be apparent to those skilled in the art to which the invention pertains. Such techniques are explained fully in the literature.

All patents, patent applications, and publications mentioned herein, both supra and infra, are hereby incorporated by reference.

What is claimed is:

1. A mobile practice target, comprising (a) a framework comprising a base support and at least one substantially vertical support extending above said base support and an angled support above said substantially vertical support, wherein the bottom of said angled support is connected directly to the top of said substantially vertical support, wherein said angled support is at an angle of from about 15 degrees to about 80 degrees relative to the substantially vertical support, (b) a common, undivided pocket comprising a resilient material having (i) at least one front opening parallel to said vertical support capable of receiving into said pocket a football propelled from the horizontal direction, and (ii) a separate top opening parallel to said angled support for receiving a propelled football from above, (c) a baffle secured to the top of said front opening which can absorb the momentum of said propelled football and/or deflect said propelled football downward into the pocket, and (d) a mobility means associated with the base support to facilitate transport of said mobile practice target, said mobility means comprising wheels, ball rollers, casters, or a combination thereof, wherein said mobile practice target captures and contains said propelled football and prevents said propelled football from bouncing out of said pocket when said propelled football traverses said front opening at speeds greater than about 30 mph.

2. The mobile practice target of claim 1, further comprising (e) one or more vertical target lines positioned across said front opening, and (f) a target image at least two feet behind said front opening.

3. The mobile practice target of claim 2, wherein said target image comprises an image of a football player.

4. The mobile practice target of claim 2, wherein the position of said one or more vertical lines is adjustable by a user.

5. The mobile practice target of claim 2, wherein the spacing between pairs of a plurality of said spaced apart vertical target lines is adjustable by a user from about 1 foot to the full width of said front opening.

6. The mobile practice target of claim 1, wherein the width and height of said front opening are at least 3 feet.

7. The mobile practice target of claim 1, wherein the length of said substantially vertical support is adjustable.

8. The mobile practice target of claim 1, wherein the angle of said angled support can be adjusted by a user from 0 degrees to 180 degrees.

9. The mobile practice target of claim 1, wherein said resilient material comprises netting with nominal string spacing of 3 to 5 inches.

10. The mobile practice target of claim 1, further comprising a second, smaller opening or a target below said front opening.

11. The mobile practice target of claim 1, further comprising hinges connecting said vertical support to said base support, and additional hinges connecting said angled support to said vertical support, such that said vertical and angled supports can be folded against said base support.

12. The mobile practice target of claim 1, further comprising one or more gas springs connected between said angled support and said vertical support, and/or between said vertical support and said base support.

13. The mobile practice target of claim 1, wherein said mobility means comprises two cambered wheels attached to said base support, wherein said cambered wheels are tilted inward at the top by from about 30 degrees to about 45 degrees from the vertical.

14. The mobile practice target of claim 1, further comprising a space-frame removably attached to said resilient material.

15. The mobile practice target of claim 1, further comprising a container, large enough to hold at least 10 footballs, in receiving relationship to a hole in the bottom of said pocket.

16. A method of training football players using the mobile practice target of claim 1, comprising throwing line passes through said front opening, and throwing lofted passes through said top opening.

17. The method of claim 16, wherein said lofted passes are aimed at a specific location on an image of a receiver.

18. The method of claim 16, wherein said line passes are aimed at a specific location on an image of a receiver and between two of said vertical target lines, wherein the spacing between said lines is set progressively smaller.

* * * * *